United States Patent [19]

Umino

[11] 4,007,756

[45] Feb. 15, 1977

[54] AIR CONTROL APPARATUS FOR AN ENGINE EXHAUST GAS PURIFICATION SYSTEM

[75] Inventor: Hideo Umino, Nagaokakyo, Japan

[73] Assignee: Mitsubishi Jidosha Kogyo Kabushiki Kaisha, Japan

[22] Filed: Aug. 20, 1975

[21] Appl. No.: 606,122

[30] Foreign Application Priority Data

Sept. 2, 1974 Japan ..... 49-101121

[52] U.S. Cl. ..... 137/115; 60/290; 137/87

[51] Int. Cl.[2] ..... G05D 11/00

[58] Field of Search ..... 60/290; 137/87, 115; 251/61, 61.1, 61.3

[56] References Cited

UNITED STATES PATENTS

| | | | |
|---|---|---|---|
| 3,805,522 | 4/1974 | Sheppard | 60/277 |
| 3,905,193 | 2/1974 | Heilman et al. | 60/290 |
| 3,921,396 | 11/1975 | Nohira | 60/290 |
| 3,924,408 | 12/1975 | Beiswenger et al. | 60/290 |
| 3,934,413 | 1/1976 | Beiswenger et al. | 60/289 |

*Primary Examiner*—William R. Cline
*Assistant Examiner*—H. Jay Spiegel
*Attorney, Agent, or Firm*—Robert E. Burns; Emmanuel J. Lobato; Bruce L. Adams

[57] ABSTRACT

An exhaust gas purifying apparatus for an engine, such as a thermal reactor or catalytic converter, is supplied secondary air through a secondary air control valve which is controlled by a combination of a first and a second differential pressure responding device. The first of these devices is responsive to the difference between a constant pressure and varying pressures of the engine manifold and of a secondary air supply means, in order to ensure the suitable secondary air feed, at low, medium and high load on the engine. A connector passage connects a passage of this first device to a pressure chamber of the second device, which actuates the secondary or control valve.

1 Claim, 4 Drawing Figures

AIR CONTROL APPARATUS FOR AN ENGINE EXHAUST GAS PURIFICATION SYSTEM

BACKGROUND OF THE INVENTION

This invention relates to apparatus for purifying exhaust gas from an internal combustion engine.

SUMMARY OF THE INVENTION

In exhaust gas purifying apparatus of the type to which secondary air is supplied from a secondary air supply source through a secondary air control valve, the primary feature of this invention lies in the use of a differential-pressure responding device having a movable wall which undergoes displacement in response to the difference between constant pressure working on one side and varying pressure working on the other side thereof, a first and a second pressure passage to supply, respectively, negative manifold pressure and secondary air supply pressure to that side of said movable wall on which the varying pressure works, a partitioning member which separates a space on that side of said movable wall on which the varying pressure works into a first pressure chamber communicating with said first pressure passage and a second pressure chamber communicating with said second pressure passage when the displacement of said movable wall reaches the predetermined value, a suction shut-off valve which is provided in said first pressure passage and opened and closed interlockingly with said movable wall, and a connector passage connected to the first pressure passage between the suction shut-off valve and the first pressure chamber. The secondary air control valve is actuated through a second differential-pressure responding device connected to the connector passage.

BRIEF DESCRIPTION OF THE DRAWINGS

Now an embodiment of this invention applied to secondary air control apparatus that supplies secondary air to such exhaust gas purifying apparatus as thermal reactor and catalytic converter that purifies exhaust gases emitted from automotive engines will be described with reference to FIGS. 1 through 4, in which.

DESCRIPTION OF THE PREFERRED EMBODIMENT

Figure 1:
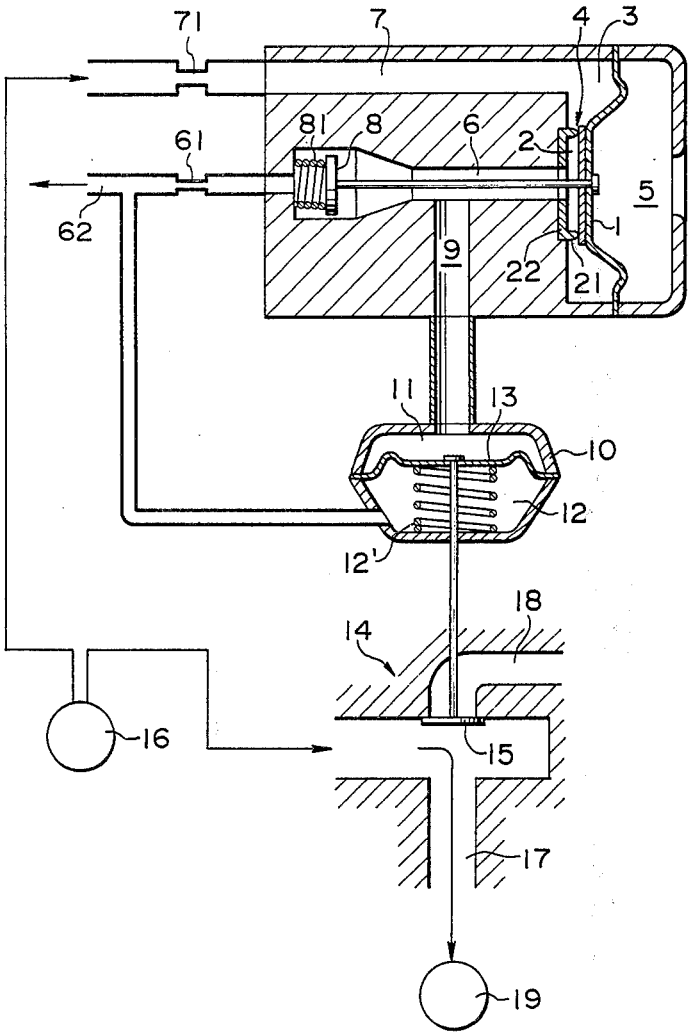
FIGS. 1 and 2 are schematic views of an embodiment of this invention.

Under the operating condition shown in FIG. 1, a first pressure chamber 2 and a second pressure chamber 3 in a common housing are separated from each other by a valve seat 22 having an annular projection 21 and a diaphragm member or movable wall device 1 which consists of a diaphragm (or a piston). Said movable wall device 1 partitions a varying pressure side 4 which includes the first and second pressure chambers 2 and 3 and a constant pressure side 5 opened to atmosphere, and is actuated by the difference between pressures in the varying pressure side 4 and the constant pressure side 5 thus providing a first differential pressure responsive device. There are also provided a first pressure passage 6 constantly communicating with the first pressure chamber 2 and a second pressure passage 7 constantly communicating with the second chamber 3, and these passages have an orifice 61 and 71, respectively, through which pressure is supplied to the first and second pressure chambers 2 and 3. Further, a suction shut-off valve 8, which is connected to the movable wall device 1 and disposed in the first pressure passage 6, is constantly urged toward the closed position of this valve by a spring 81. Between the negative pressure open-close valve 8 and the first pressure chamber 2, a connector passage 9 communicates with the first pressure passage 6. There is also provided a second differential responsive device 10 for controlling the supply of secondary air it comprises a casing partitioned by a movable wall 13 which takes the form of a diaphragm in this embodiment. In the casing of device 10 one chamber 11 communicates with the connector passage 9 and the other chamber 12 communicates with a suction port 62 leading to the manifold intake for the engine when valve 15 is open pipe of an engine not shown. A secondary air control valve device 14, which consists of a valve 15 connected to the movable wall 13, selectively directs air supplied from an air pump 16, which serves as a secondary air supply source, to a passage 17 leading to exhaust gas purifying apparatus 19 or to a passage 18 opening to atmosphere when the valve is closed. Suction from the engine manifold is supplied through the orifice 61 to the first pressure passage 6, while positive pressure from the air pump 16 is supplied to the second pressure passage 7.

Figure 3:
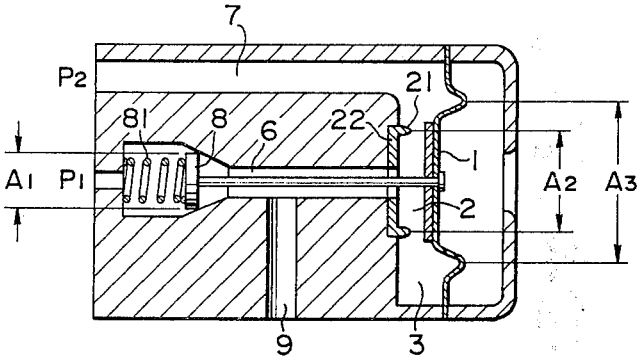
FIG. 3 is a schematic view illustrating the principal parts of the same embodiment.

We can identify the operating conditions by specifying as shown in FIG. 3, that the total effective area of the movable wall 1 is A3, the area inside the annular projection 21 is A2, the area of the suction shut-off valve 8 is A1, the negative manifold pressure in the first pressure passage 6 is P1, the positive air-pump pressure in the second pressure passage 7 is P2, and the urging force of the spring 81 is F. Accordingly, the negative pressure P1 must be increased as given by the following equation, in order to move the movable wall 1, which is originally in the right position as shown in FIG. 3, to the left.

$$P1 \geqslant \left(\frac{A3 - A1}{A1}\right) \times P2 + \frac{F}{A1} \qquad \text{(a)}$$

Then, in order to move the movable wall 1, resting on the valve seat 22 on the left, to the right, the negative pressure P1 must be decreased as given by the following equation.

$$P1 \leqq \left(\frac{A3 - A2}{A2}\right) \times P2 + \frac{F}{A2} \qquad \text{(b)}$$

Figure 4:
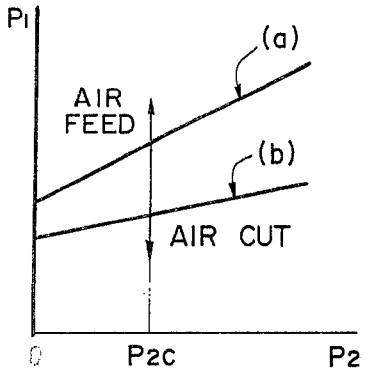
FIG. 4 is a graphic representation of the operation of the embodiment.

The relationship between the above equations (*a*) and (*b*) will be explained in connection with FIG. 4. Let us first assume that the pressure P2 of the air pump is constant, or the engine is rotated at a constant rate, as indicated by a two-dot-dash line P2*c*. If load is low or negative, that is, if the accelerator is opened to a small extent and the negative manifold pressure P1 is large, secondary air is constantly supplied to the exhaust gas purifying apparatus as hereinafter described with reference to FIG. 1. More particularly, when the negative manifold pressure P1 exceeds the critical value shown on the right side of equation (*a*), the movable wall 1 rests on the valve seat 22, whereby the negative manifold pressure P1 is supplied through the orifice 61 and the passage 9 to the chamber 11 of the movable wall device 10. In the meantime, the negative manifold pressure P1 is constantly introduced direct to the chamber 12. Therefore, the movable wall 13 is pushed up by the force of a bias spring 12', thereby raising the valve 15 to close the passage 18 leading to atmosphere. As a consequence, air delivered from the air pump 16 is supplied through the passage 17 to the exhaust gas purifying apparatus 19.

Figure 2:
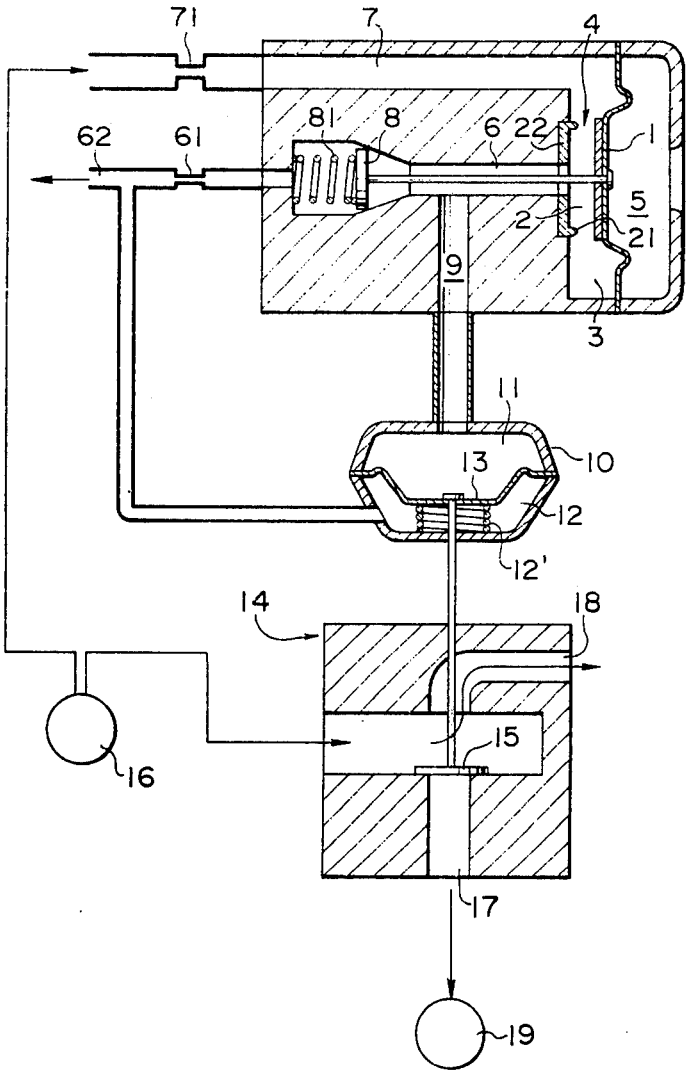

If load is high, that is, if the accelerator is opened to a great extent and the negative manifold pressure P1 is low, the value of P1 becomes smaller than the critical value shown on the right side of equation (*b*). Consequently, the movable wall 1 departs from the valve seat 22, and the suction shut-off 8 comes in contact with the wall of the passage 6 to intercept the introduction of negative pressure to the passage 9, as illustrated in FIG. 2. Accordingly, the positive pressure from the air pump 16 is introduced into the chamber 11 through the passages 7 and 9. Then, the force of the bias spring 12' is overcome by the pressure difference built up between the positive pressure in the chamber 11 and the negative pressure in the chamber 12, whereby the valve 15 is lowered to close the passage 17. Therefore, the secondary air supplied from the air pump 16 is discharged into atmosphere through the passage 18.

The operation under medium load will be as follows: If, under such load, air is initially supplied to the exhaust gas purifying apparatus 19, as is illustrated in FIG. 1, the supply of air stops when the negative manifold pressure becomes smaller than the value expressed by equation (*b*), or when the accelerator is opened to a great extent, as shown in FIG. 4. If, on the other hand, under medium load, air is hot initially supplied to the exhaust gas purifying apparatus 19, as is illustrated in FIG. 2, the supply of air starts when the negative manifold pressure becomes larger than the value expressed by equation (*a*), or when the accelerator is opened to a small extent (as in the case in which engine brake is used), as shown in FIG. 4.

Because of the above-described feature, this invention permits free selection of individual reciprocating points of the valve 15, and selective transmission of positive-pressure and negative-pressure signals. In its use for controlling the supply of secondary air to the exhaust gas purifying apparatus, it makes it possible to separately establish time points to start and stop the supply of air in accordance with the running condition of the vehicle. Therefore, the amount of air supplied to the exhaust gas purifying apparatus is always kept at the level needed by this apparatus, and the supply of air is stopped while the engine operates under a high load. This prevents excessive rise in the temperature of exhaust gases leaving the exhaust section of the engine, and the temperature of the exhaust gas purifying apparatus itself.

When the engine speed is accelerated to a high-load region and then the throttle valve is suddenly closed for the purpose of gear shifting, the air-fuel mixture becomes temporarily rich, and uncombusted substances in the engine exhaust increase. If secondary air is supplied under such condition, in which condition the exhaust system of the engine is heated to high temperature, the unburned substances in the engine exhaust rapidly react with the secondary air and thereby give rise to so-called after-burning, which is liable to cause damage to said exhaust system. According to this invention, such after-burning can be prevented effectively, since the supply of secondary air is stopped in the high-load region and, therefore, the temperature of the exhaust system is low.

What is claimed is:

1. Air control apparatus for an engine exhaust gas purifier, comprising:

air supply means for supplying air at super-atmospheric pressure for selective application of the air to an exhaust gas purifier of an engine;

an air control valve for operation to selectively connect air, supplied by the supply means, to the purifier and to the atmosphere, for said selective application of the air;

a differential-pressure responsive device for operating the valve, the device having a casing, a movable member dividing the casing into first and second compartments, means for applying to the first compartment a suction of an intake manifold of the engine, means defining a connector passage for applying a control pressure to the second compartment and for thereby providing a pressure differential acting on the movable member, and means connecting the movable member to the air control valve for moving the valve by the member in response to the differential;

a differential-pressure responsive unit for controlling the differential-pressure responsive device, the unit having a housing and having, disposed therein, a diaphragm member dividing the housing into a first portion and a second portion, and means for applying a constant pressure to the first portion and to a first side of the diaphragm member therein;

means for applying variable pressures to the second portion of the housing and to a second side of the diaphragm member therein, comprising (a) a fixed partition in the housing, having a valve seat thereon and disposed in the second portion of the housing to divide the second portion into a pressure chamber surrounding the valve seat and a suction chamber surrounded by the valve seat if the diaphragm member contacts the valve seat, the diaphragm member being enabled by predetermined differentials between the constant and variable pressures selectively to effect the contacting of the valve seat and to move to positions remote from the valve seat, (b) a pressure passage in the housing for applying air at super-atmospheric pressure, supplied by the air supply means, to the second portion of the housing, outside of the valve seat, (c) a suction passage in the housing for applying the suction of the intake manifold to the second portion of the housing, inside of the valve seat, and (d) a suction shut-off valve in the housing, connected to the diaphragm member and disposed in the suction passage to open that passage if the diaphragm member contacts the valve seat, and progressively to close the passage if the diaphragm member progressively moves to positions remote from the valve seat; and means establishing communication of the suction passage in the housing with the connector passage to the second compartment of the casing of the differential-pressure responsive device to provide the control pressure acting on the movable member in that device for moving the air control valve;

whereby the selective connecting of air to the purifier can be performed by the air control valve while the suction of the intake manifold varies, and also while the suction remains uniform.

* * * * *